US006926567B1

(12) United States Patent
Dai et al.

(10) Patent No.: US 6,926,567 B1
(45) Date of Patent: Aug. 9, 2005

(54) DIRECTIONAL STEERING CONTROLLED JET PROPULSION

(75) Inventors: Charles M. Dai, Potomac, MD (US); Carl W. Baumann, Chantilly, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/863,846

(22) Filed: Jun. 3, 2004

(51) Int. Cl.[7] ..... B63H 11/107
(52) U.S. Cl. ..... 440/40; 114/151
(58) Field of Search ..... 440/40, 43; 114/151

(56) References Cited

U.S. PATENT DOCUMENTS 5,505,639 A * 4/1996 Burg ..... 440/42
5,591,057 A 1/1997 Dai et al.
6,171,159 B1 * 1/2001 Shen et al. ..... 440/43

* cited by examiner

*Primary Examiner*—Jesus D. Sotelo
(74) *Attorney, Agent, or Firm*—Jacob Shuster

(57) ABSTRACT

An elongated fluid dynamic water jet type of propulsion body receives an inflow of fluid through inlet openings for entry into a jet propulsor from which an outlet jet emerges for passage through an internal transition passage to an exit end between two pairs of horizontal flaps hinged to the body at the exit end for angular displacement about parallel spaced horizontal axes from horizontal neutral positions. Four pair of flaps are pivotally mounted within the transition passage for angular displacement about parallel spaced vertical axes from neutral positions. Actuators inside of the propulsion body connected to the flaps are selectively controlled to impart in-phase angular displacement to all of the flaps about their horizontal and vertical axes from the neutral positions for directional steering by angular deflection of the jet exit outflow from the exit end of the body. To reverse propulsion, only the actuators for the horizontal flaps are activated in an out-of-phase mode to effect angular displacement of each pair of the horizontal flaps in opposite directions into engagement with each other thereby blocking jet outflow from the exit end of the body causing a directional reversal of the propulsion jet by outflow from openings formed in the body rearwardly of the exit end.

3 Claims, 4 Drawing Sheets

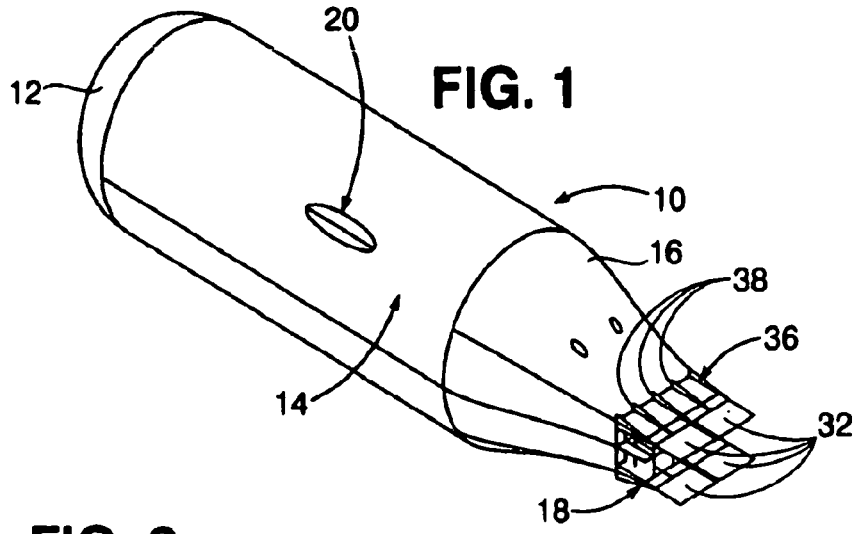
FIG. 1
FIG. 2
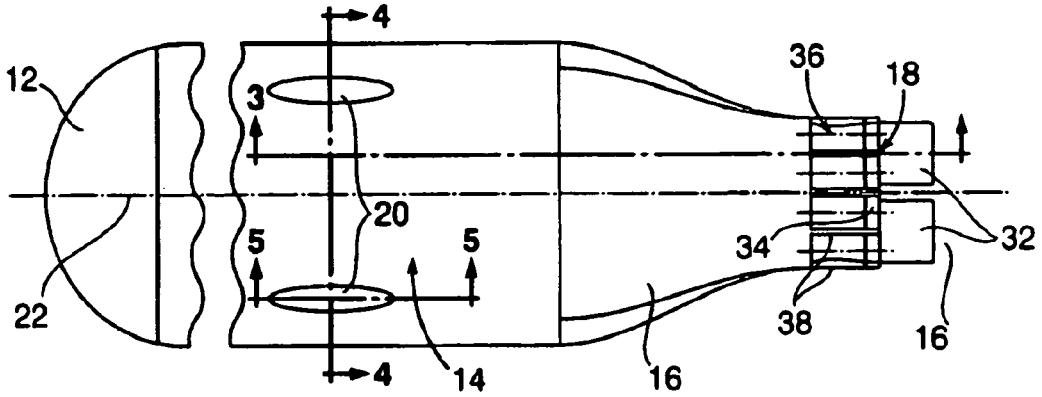
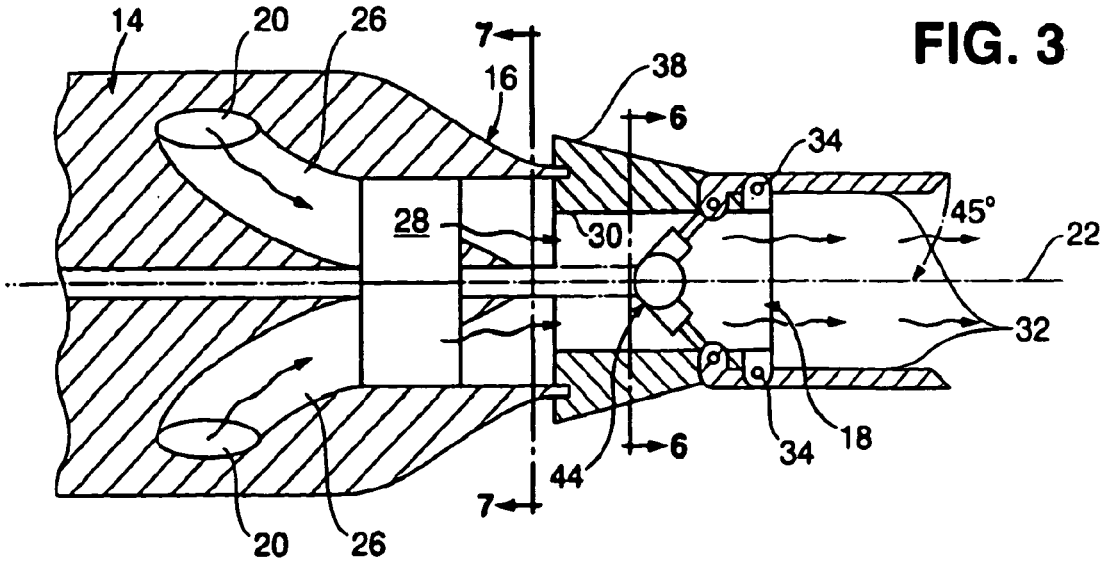
FIG. 3

DIRECTIONAL STEERING CONTROLLED JET PROPULSION

STATEMENT OF GOVERNMENT INTEREST

The invention described herein may be manufactured and used by or for the Government of the United States of America for governmental purposes without the payment of any royalties thereon or therefore.

The present invention relates generally to fluid dynamic jet stream propulsion of seawater vehicles under directional steering control.

BACKGROUND OF THE INVENTION

Waterjet propulsors for seawater surface and submersible vehicles heretofore involved use of directional controlling devices featuring a steering sleeve with a reversing bucket to control vehicle steering during jet propulsion, by deflection of water jets emerging from the sleeve into the reversing bucket for directional reversal of propulsion. Control linkages for such directional control devices located outside the vehicle undergoing jet propulsion were vulnerable to damage and constituted a serious source of drag, especially where the vehicle is of a submersible type. It is therefore an important object of the present invention to provide for water jet propulsion with directional steering and reversing controls, which avoids the damage vulnerability and drag problems heretofore experienced.

SUMMARY OF THE INVENTION

Pursuant to the present invention a water jet propulsion vehicle has an aft convergent body section within which one transition passage is formed terminated at an exit end from which forward propulsion jets emerge during overflow while fluid inflow is received through inlets formed in the vehicle body forwardly of the convergent aft section. The propulsion jets emerging at the exit end are under directional steering control of horizontal flaps hinged to the vehicle body at the exit end for adjusted angular displacement under internal in-phase steering control about parallel spaced horizontal axes of the vehicle body. Such steering control also involves in-phase angular displacement of vertical flaps about parallel spaced vertical axes within the transition passage in the convergent aft body section. Directional reversal of propulsion is effected by exclusive out-of-phase angular displacement of the horizontal flaps under internal control into end contact with each other so as to block jet outflow from the exit end of the vehicle body thereby forcing jet outflow through outlets formed axially between the exit end and the inlets.

DESCRIPTION OF THE DRAWING

A more complete appreciation of the invention and many of its attendant advantages will be readily appreciated as the same becomes better understood by reference to the following detailed description when considered in connection with the accompanying drawing wherein:

FIG. 1 is a perspective view of a water jet propelled vehicle body;

FIG. 2 is a top plan view of the propelled vehicle body shown in FIG. 1;

FIG. 3 is a transverse view taken substantially through a plane indicated by section line 3—3 in FIG. 2;

DETAILED DESCRIPTION OF PREFERRED EMBODIMENT

Figure 6:
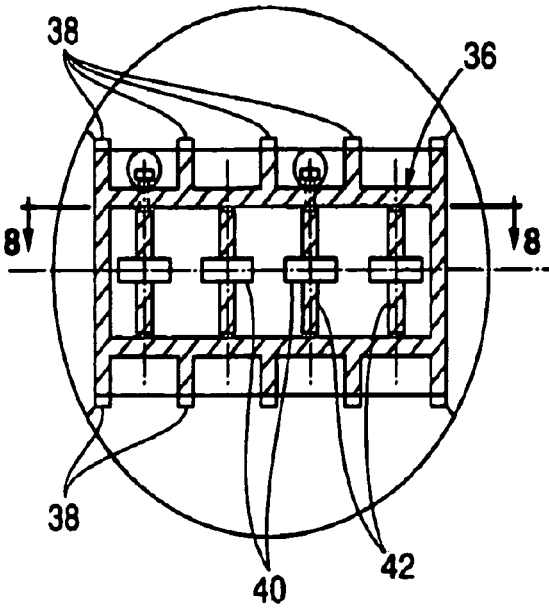
FIGS. 6 and 7 are transverse section views taken substantially through planes indicated by section lines 6—6 and 7—7 in FIG. 3.
Figure 7:
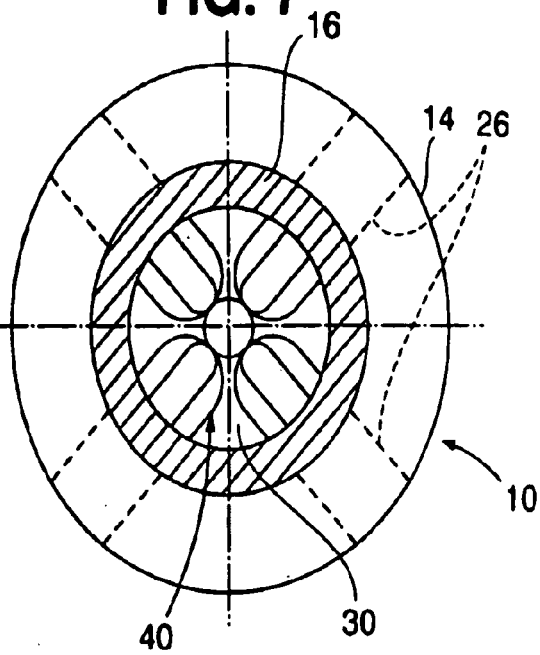
Figure 8:
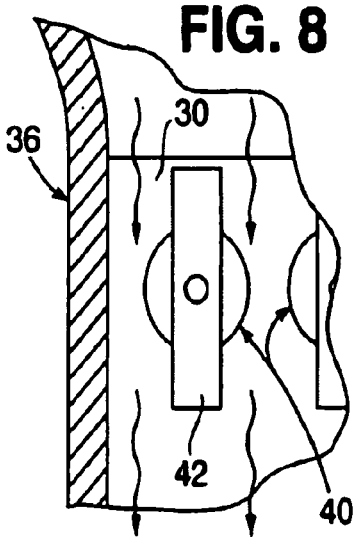
FIG. 8 is a partial section view taken substantially through a plane indicated by section line 8—8 in FIG. 6.
Figure 8A:
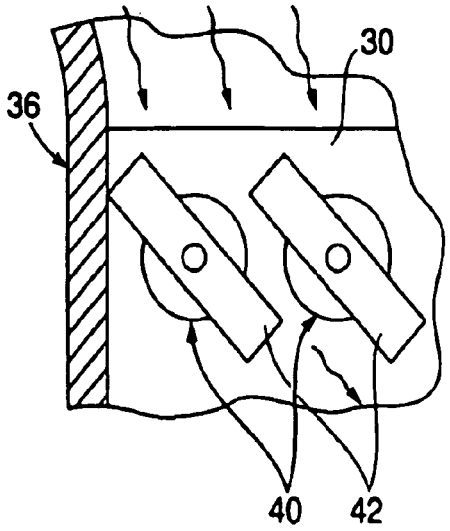
FIG. 8A is a partial section view corresponding to that of FIG. 8, showing another operational phase.

Referring now to the drawing in detail, FIGS. 1, 2 and 3 illustrate an axially elongated water jet propulsion vehicle 10 which may for example be hydrodynamically integrated with a seawater hull for propulsion thereof. The vehicle 10 has a bow end 12 from which a cross-sectionally cylindrical body section 14 extends to a cross-sectionally converging conical section 16 terminating at a rectangular exit end 18 from which propulsion jets emerge. Four water inflow inlet openings 20 are formed in the cylindrical section 14 of the body 10, located in angularly spaced relation to each other about a central axis 22 of the body 10. Cross-sectionally circular ducts 26 extend inwardly into the body 10 from each of the four inlets 20 to direct inflow of water to an assembly of propulsors 28 from which the propulsion jets exit into a one transition passage 30 within a cross-sectionally rectangular duct 36 so as to emerge from the exit end 18 of the body 10 for propulsion thereof. Pursuant to the present invention the propulsion exit jets emerging from the transition passage 30 at the body exit end 18 are directionally controlled vertically by vertically spaced upper and lower pairs of horizontal flaps 32, pivoted by actuators 44 about parallel spaced horizontal axes established through hinges 34 at the body end 18. As shown in FIGS. 3 and 6, the hinges 34 are fixed to the cross-sectionally rectangular duct 36 through which parallel spaced fins 38 externally project. Positioned within the duct passage 30 as shown in FIGS. 7 and 8 are four horizontally aligned gear box actuators 40 through which four pair of vertically aligned flaps 42 are simultaneously rotated about four parallel spaced vertical axes extending through the transition passage 30 in the duct 36 to directionally control exiting of the propulsion jets horizontally from the duct passage 30.

Referring now to FIGS. 3, 3A, 3B, 8 and 8A, the two pairs of the horizontal flaps 32 and the four vertical flaps 42 are respectively angularly adjusted in phase about their two horizontal axes and their four vertical axes between −45° and +45° from neutral positions in alignment with their horizontal or vertical axes, in order to correspondingly directionally change exit flow of the propulsion jets from the end 18 of the body 10. Thus, FIGS. 3 and 8 respectively illustrate the flaps 32 and 42 in their neutral positions while FIGS. 4A and 8A respectively illustrate the flaps 32 and 42 angularly displaced in phase in the same angular direction from their neutral positions to correspondingly change the direction of propulsion both horizontally and vertically for full steering of the body 10.

Figure 3A:
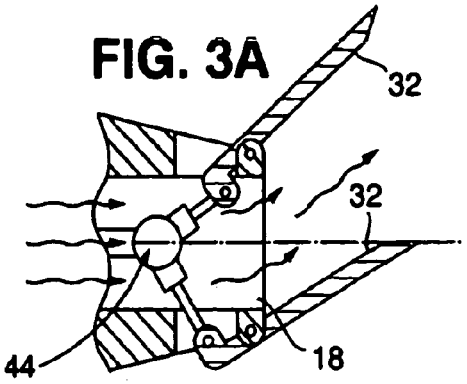
FIGS. 3A and 3B are partial section views corresponding to FIG. 3, showing the water jet propelled vehicle body in different operational phases.
Figure 3B:
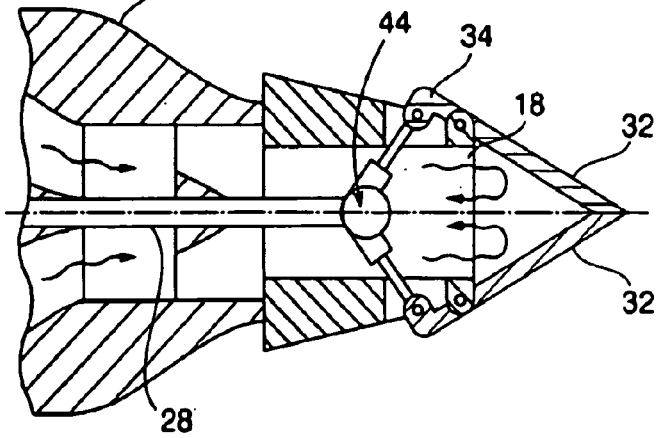
Figure 4:
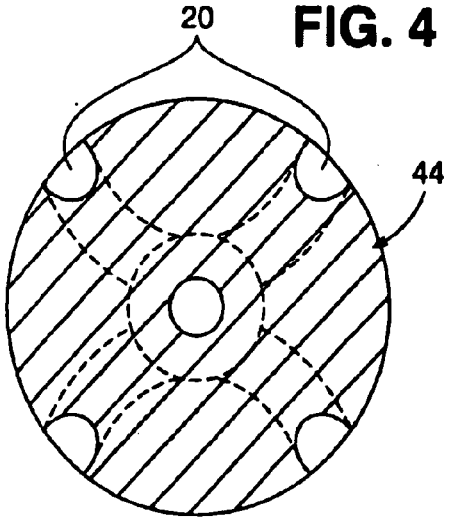
FIG. 4 is a partial section view taken substantially through a plane indicated by section line 4—4 in FIG. 2.
Figure 5:
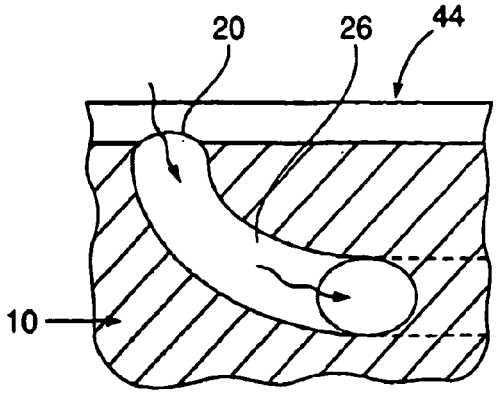
FIG. 5 is a partial section view taken substantially through a plane indicated by section line 5—5 in FIG. 2.

In addition the foregoing referred to adjustments of propulsion jets exiting from the body 10 for forward propulsion thereof, reverse propulsion of the body 10 may be induced by out-of-phase angular displacement of each pair of the horizontal flaps 32 from their neutral positions to positions with their outer ends in contract with each other as shown in FIG. 3B. Forward directional outflow of the propulsion jets are thereby blocked. As shown in FIGS. 3, 3A and 3B, such directionally controlled angular adjustments of the horizontal flaps 32 is effected through the actuators 44 pivotally connected to the inner ends of the horizontal flaps 32.

Figure 9:
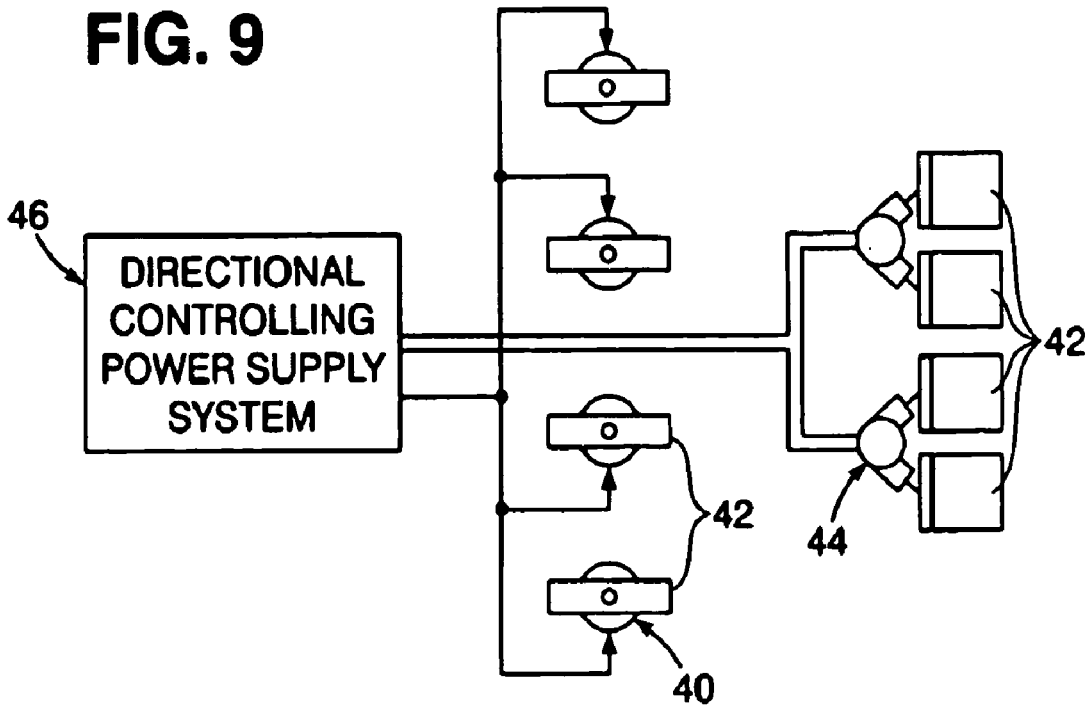
FIG. 9 is a diagram of a directional controlling power supply system associated with the water jet propelled body shown in FIGS. 1–7.

As diagrammed in FIG. 9, a directional controlling power supply system 46 is associated with the gear box actuators 40 for the vertical flaps 42 and the actuators 44 for the horizontal flaps 32. The actuators 40 and 44 are thereby selectively energized to effect the angular adjustments of the flaps 32 and 42 in the horizontal and vertical directions for forward steering control and for reverse directional control as hereinbefore described. The flaps 32 and 42, the actuators 40 and 44 and the dimensional relationships between such components may be varied to meet different propulsion requirements associated with the body 10.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a fluid dynamic body undergoing propulsion by water jet emergence from an exit end of the body, a system for internally controlling directional steering during forward propulsion and reversal of said propulsion, comprising one transition passage duct formed within the body and extending to said exit end thereof; flap means pivotally mounted on the body for angular displacement from neutral positions forwardly directing said water jet emergence from the transition passage duct at the exit end; forward steering means for inducing said angular displacement of the flap means in an in-phase mode from the neutral positions to effect said directional steering; and reversing means for restrictively inducing said angular displacement of the flap means in directionally opposite direction during an out-of-phase mode to effect said reversal of the propulsion;

wherein said reversal of the propulsion is effected by water jet outflow during said out-of-phase mode from outlets in the body spaced from the exit end;

and wherein the flap means includes: a pair of horizontal flaps respectively undergoing said angular displacement during said in-phase mode in one angular and during said out-of-phase mode in opposite angular directions into engagement with each other to block said water jet emergence from transition passage duct to the exit end of the body.

2. In combination with a fluid dynamic body undergoing propulsion by water jet emergence from an exit end of the body, a system for internally controlling directional steering during forward propulsion and reversal of said propulsion, comprising flap means pivotally mounted on the body for angular displacement from neutral positions forwardly directing said water jet emergence from the exit end; forward steering means for inducing said angular displacement of the flap means in an in-phase mode from the neutral positions and in perpendicular directions thereto to effect said directional steering; and reversing means for restrictively inducing said angular displacement of the flap means in a directionally opposite out-of-phase mode to effect said reversal of the propulsion, the flap means including: a pair of horizontal flaps respectively undergoing said angular displacement during said in-phase mode in one of the perpendicular directions and during the out-of-phase mode in opposite perpendicular directions into engagement with each other to block said water jet emergence from the exit end of the body.

3. The combination as defined in claim 2, wherein said water jet emergence from the exit end of the body involves outflow through one cross-sectionally rectangular transition passage duct under directional control of said pair of flaps hinged to the body at said outlet end; and inflow to the transition passage duct of propulsion pressurized fluid from a circular passage upstream of the transition passage.

* * * * *